US005916073A

United States Patent [19]

Ellis

[11] Patent Number: 5,916,073

[45] Date of Patent: Jun. 29, 1999

[54] ABDOMINAL EXERCISE DEVICE AND METHOD

[75] Inventor: John S. Ellis, Rancho Santa Margarita, Calif.

[73] Assignee: Endurance Plus, Inc., Rancho Santa Margarita, Calif.

[21] Appl. No.: 08/609,101

[22] Filed: Feb. 29, 1996

[51] Int. Cl.[6] ..... A63B 23/02

[52] U.S. Cl. ..... 482/140; 482/10; 482/131; 482/139

[58] Field of Search ..... 482/10, 95, 137, 482/132, 140, 139, 142, 148; 602/19; 601/39; 606/240; 5/636, 637, 643; 128/845, 869, 870; D21/191, 193; D24/190, 191; D29/102

[56] References Cited

U.S. PATENT DOCUMENTS

| | | | |
|---|---|---|---|
| D. 323,218 | 1/1992 | Kamensky | D24/191 |
| D. 337,824 | 7/1993 | Campbell | D24/191 |
| 3,522,804 | 8/1970 | Towbin | 128/869 |
| 4,736,736 | 4/1988 | Moers et al. | 5/637 |
| 4,752,067 | 6/1988 | Colonello | 482/140 |
| 5,100,130 | 3/1992 | Shoebrooks . | |
| 5,169,372 | 12/1992 | Tecco | 482/140 |
| 5,267,931 | 12/1993 | Faetini . | |
| 5,279,310 | 1/1994 | Hsien | 606/240 |
| 5,295,949 | 3/1994 | Hathaway . | |
| 5,337,427 | 8/1994 | Pagano et al. . | |
| 5,368,537 | 11/1994 | Felice . | |
| 5,409,450 | 4/1995 | Donelson | 602/19 |
| 5,637,067 | 6/1997 | Ausmus | 482/140 |

FOREIGN PATENT DOCUMENTS

| | | | |
|---|---|---|---|
| 3326078 | 1/1985 | Germany | 482/140 |

*Primary Examiner*—Jeanne M. Clark
*Attorney, Agent, or Firm*—Sheridan Ross P.C.

[57] ABSTRACT

The exercise device of the present invention has an elongated member that extends from a user's head to the user's upper back for providing back support during abdominal crunches. The member is curved to conform to the user's cervical lordosis and kyphotic curve formed by the user's thoracic vertebrae and has a tapered lower portion to provide freedom of movement.

24 Claims, 8 Drawing Sheets

ABDOMINAL EXERCISE DEVICE AND METHOD

FIELD OF THE INVENTION

The present invention is generally directed to exercise devices and more specifically to devices for exercising abdominal muscles.

BACKGROUND OF THE INVENTION

A primary technique for strengthening and toning abdominal muscles, such as the rectus abdominous, is the abdominal crunch or sit-up. To perform a crunch, a person lies on his back and bends his knees by drawing his heels in towards his buttocks. He then curls his upper body into a concave position so the head, neck and shoulders are slightly elevated off the floor and the elbows are contacting the knees. In this position, the rectus abdominous is contracted. He returns to the starting position, thereby relaxing the muscle, and repeats the sequence of steps for a desired number of repetitions.

Abdominal crunches can cause many physical ailments. As the number of repetitions increases, not only the rectus abdominous but also the neck muscles weaken (because the neck muscles must support the head). A person can attempt to compensate for the weakened rectus abdominous by jerking his head and upper back to help complete the repetitions. The jerking motion can further weaken the neck muscles and possibly lead to neck and/or back injuries. Although he can place his hands behind his neck to support the neck, he will have a tendency to pull up on his arms to help complete repetitions, which neutralizes the benefits of supporting the neck with the hands.

A number of devices have been designed to reduce the stress on the neck experienced during crunches. In one device disclosed in U.S. Pat. No. 5,458,549 ("the '549 patent"), the exercise device has an elongated sheet of flexible, resilient, cushioned material and a substantially rigid support panel attached to the backside, which supports the head, neck and upper back of the user during crunches. The flat device extends from the head region to the buttocks region (to permit the lower end of the device to be held in position during the crunches). This device has a number of problems. The length of the device restricts the user's freedom of movement in crunches, especially in crunches that require the upper body to rotate from side to side. The substantially rigid support panel limits the ability of the device to conform to the lordotic and kyphotic curves, thereby causing user discomfort.

Another device is disclosed in U.S. Pat. No. 5,169,372 ("the '372 patent"). The device has a head-receiving portion that is placed against the head of the user. A base of the device is placed against the back of the user's neck to support the user's head and neck and partially support the weight of the user's head during abdominal crunches. The device includes grooves that function as handles for the user. Like the device of the '549 patent, this device has drawbacks. Because the base rests on the occipital bone (i.e., the base of the skull), the device fails to eliminate neck and back strains during crunches.

SUMMARY OF THE INVENTION

It is an objective of the present invention to provide an exercise device that substantially inhibits neck and back strain during abdominal crunches. Related objectives are to provide a device that supports the head and neck during crunches, inhibits jerking of the head and neck during crunches, permits fluidity of movement during crunches, and readily conforms to the lordotic and kyphotic curves of a user.

Another objective is to provide an exercise device that inhibits jerking of the hands and arms during crunches.

These and other objectives are provided by the exercise device of the present invention. In a first aspect of the present invention, the device includes an elongated member extending the length of a portion of a user's spinal column. The upper end of the member is located adjacent to the user's head, and the lower end of the member is located adjacent to the user's upper back. The lower end is preferably located adjacent to one of the second, third, fourth, and fifth thoracic vertebrae of the user, with the most preferred position being adjacent to the fourth thoracic vertebrae. The length of the member provides the user with freedom of movement, especially in side-to-side crunches, and minimizes discomfort from the member rubbing against the user's back during crunches.

To avoid discomfort to the user when in the supine position, the lower end is tapered in thickness relative to the remainder of the member. The preferred thickness of a semi-rigid layer located at the lower end at the end of the taper is no more than about ⅛ inch.

To provide a desired amount of pliability, the member includes the semi-rigid layer. The semi-rigid layer is able to conform to the irregularities in the lordotic and kyphotic curves of different users while providing adequate levels of spinal support. The semi-rigid layer can be polyethylene, polypropylene, and composites and has a preferred thickness ranging from about 2.5 to about 4 mm.

The member can also include handholds. The handholds are positioned substantially at the midpoint of the cervical lordosis of the user to maintain the spine in a neutral position. The handholds inhibit jerking of the user's hands and arms during abdominal exercises.

In another aspect of the present invention, the elongated member is fabricated to have a curved shape before engagement with the user's back. The curved shape permits the member to substantially conform to the cervical lordosis and kyphotic curve of the user. The fabricated curved shape in the member is able to maintain the spine in a neutral position throughout the full range of body motion in a crunch. It thus provides superior spinal support compared to the flat abdominal exercising devices of the prior art.

In yet another aspect of the present invention, the elongated member has an upper portion for supporting the user's head, a middle portion for supporting the user's neck, and a lower portion for supporting the user's upper back. The sides of the lower portion are tapered to provide the user with freedom of lateral movement during abdominal exercises and thereby minimize discomfort from the member rubbing against the user's back during exercising. The width of the member at the junction between the middle and lower portions preferably ranges from about 6.5 to about 7.0 inches and at the lower end of the lower portion from about 4.0 to about 4.50 inches.

The superior spinal support of the device of the present invention inhibits neck and back strain during abdominal exercises and permits better isolation of the abdominal muscles during crunches than is possible with existing devices. The ability of the device to hold the spine in a neutral position eliminates problems caused by jerking of the head and neck during abdominal exercises and thereby minimizes ancillary muscle recruitment.

The device of the present invention is compact and lightweight. The device thus has a high degree of portability. By way of example, the device can be carried in luggage during travel.

DETAILED DESCRIPTION

Figure 1:
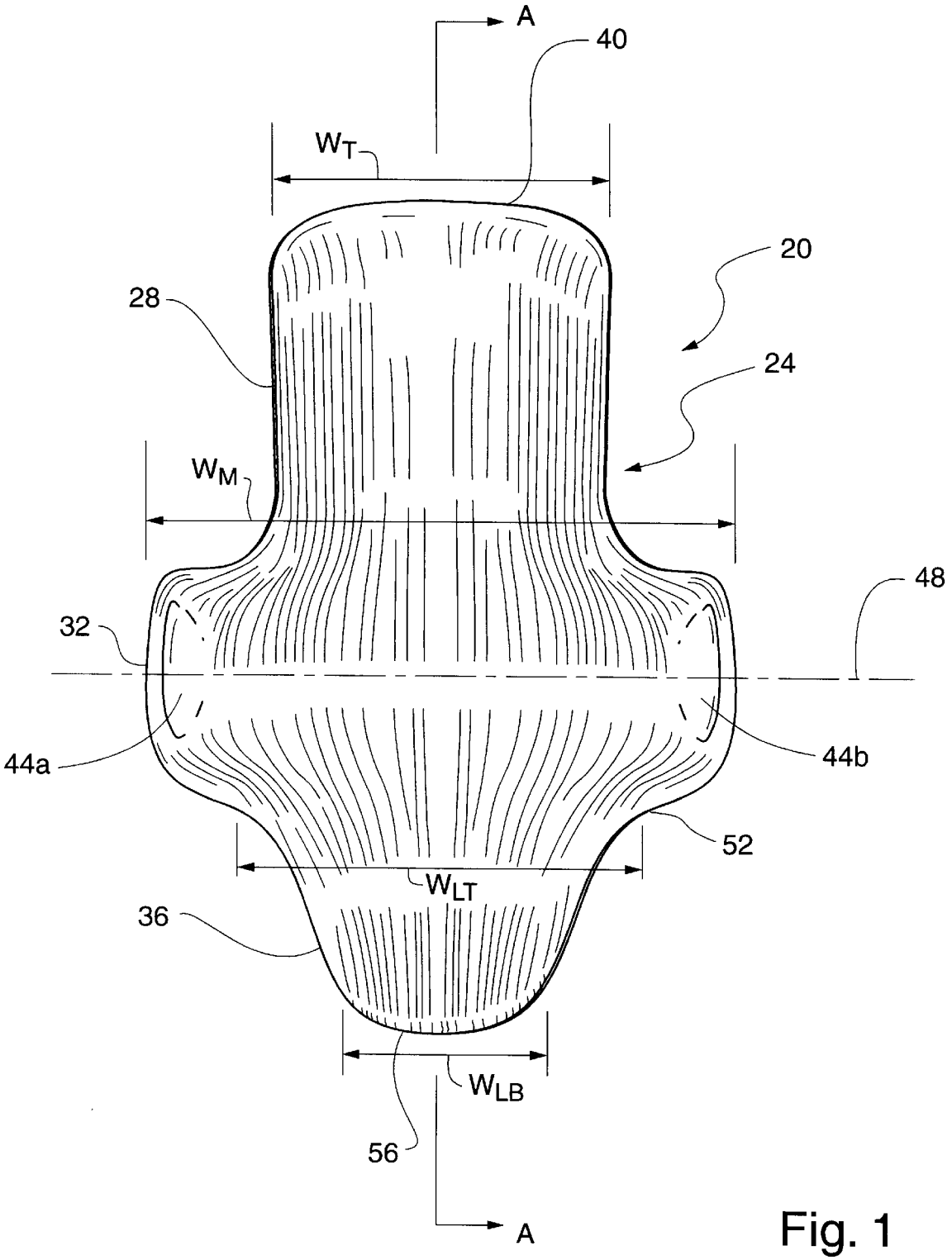
FIG. 1 is a plan view of a first embodiment of the exercise device of the present invention.

Referring to FIGS. 1–4, a first embodiment of the exercise device 20 of the present invention is illustrated. The device includes an elongated member 24 having upper, middle and lower portions, 28, 32, 36. The upper portion 28 supports the user's head, the middle portion 32 the user's neck, and the lower portion 36 the user's upper back.

The elongated member is fabricated to have a curved profile to conform to the user's lordotic and kyphotic curves to better immobilize the user's head, neck, and upper back during crunches. The upper portion 28 of the exercise device 20 has a curved profile to conform to the back of the user's head, the middle portion 32 a curved profile to conform to the back of the user's neck (i.e., the lordotic curve formed by the cervical vertebrae or cervical lordosis), and the lower portion 36 a curved profile to conform to the user's upper back (i.e., the kyphotic curve formed by the superior aspect of the thoracic vertebrae). The fabricated curved profile of the device permits the elongated member to remain flush with the cervical lordosis and kydosis during crunches without requiring the user to exert a strong upward force on the device. In this manner, the device maintains the cervical spine in a neutral position throughout the abdominal exercise.

The widths of the upper, middle, and lower portions are important to the effectiveness and versatility of the device. The width "$W_T$" of the upper portion 28, as measured at the upper end 40, preferably ranges from about 5.00 to about 5.75 inches with the most preferred width being about 5.50 inches. The middle portion 32 is wider than the upper and lower portions to permit the user to grip handholds 44 to hold the device 20 in position during crunches. The width "$W_M$" preferably ranges from about 10.0 to about 10.50 inches with the most preferred width being about 10.25 inches. The lower portion is tapered at the sides with the taper ending at the lower end 56 which has a semi-circular shape. The semi-circular shape prevents user discomfort caused by sharp edges or corners or protrusions. The maximum width $_{LT}$" of the lower portion 36 must be great enough to avoid discomfort to the user yet low enough to avoid hindering the movement of the user during the crunch, especially in side-to-side crunches. By way of example, if the width of the lower portion is too great, the lower portion can cause impingement of the medial border of the scapula during the exercise. The maximum width is preferably no more than about 6.50 inches and more preferably no more than about 5.25 inches. Preferably, the width "$W_{LB}$" at the lower end of the taper ranges from about 4.25 to about 4.50 inches. The width at the portion of the lower end 56 having a semi-circular shape more preferably ranges from about 3.50 to about 4.50 inches and most preferably from about 3.50 to about 3.75 inches.

The position of the handholds 44*a,b* on the middle portion 32 is important to the ability of the device to neutralize the spine during the full range of motion of the crunch. The centerline 48 of the handholds 44*a,b* preferably is located at the midpoint of the cervical lordosis. More preferably, the centerline 48 is located between and including the third and fifth cervical vertebrae. If the centerline 48 were located at the first or second cervical vertebrae, the user's head would tip forward during the crunch. If the centerline 48 were located at the sixth or seventh cervical vertebrae, the head would tip back during the crunch. The handholds 44 are formed by a curved lip on the underside of the middle portion.

The length of the lower portion 36 is important to the effectiveness of the device. If the lower portion 36 were to extend too far down the user's back, the lower portion 36 could rub the user's back during exercising, thereby limiting the number and effectiveness of exercises that could be performed by the user. This is especially true for side-to-side crunches. If the lower portion 36 were not to extend far enough down the user's back, the lower portion 36 could fail to maintain the spine in a neutral position during exercising. That is, the lower portion 36 could have insufficient contact surface with the curvature of the spine to provide adequate spinal support. Preferably, the lower end 56 of the lower portion 36 is located adjacent to one of the second, third, fourth, and fifth thoracic vertebrae, more preferably to one of the third, fourth, and fifth thoracic vertebrae, and most preferably to the third thoracic vertebrae. Stated another way, the distance from the centerline 48 to the lower end 56 preferably ranges from about 6⅛ to about 7 inches and more preferably from about 6⅛ to about 6⅜ inches with the most preferred distance being about 6.25 inches. If the length of the lower portion is too long, when the user attempts to return to a neutral position the lower end of the lower portion will contact the ground prematurely (i.e., will contact the ground before the upper area of the lower portion) causing uneven movement of the user during the exercise. The distance from the centerline 48 to the upper end 40 preferably ranges from about 8.0 to about 8.5 inches with the most preferred distance being about 8.25 inches. The total length "L" of the elongated member from the upper end 40 to the lower end 56 preferably ranges from about 13.75 to about 15.5 inches with the most preferred length "L" being about 14½ inches.

The lower portion 36 is tapered symmetrically about the longitudinal axis of the elongated member (which lies along the centerline of the user's spinal column) to enable the user to perform side-to-side crunches without discomfort or loss of fluidity of movement. The amount of the taper depends upon the width and length of the lower portion. The width "$W_{LT}$" of the lower portion 36 measured at the lower end 52 of the middle portion (i.e., the point where the taper of the lower portion begins which is at the first thoracic vertebrae) preferably ranges from about 6.5 to about 7.0 inches. The width "$W_{LB}$" was discussed above. The length of the lower portion from the lower end 52 of the middle portion (which is located at the third or fourth thoracic vertebrae) to the lower end 56 of the lower portion preferably ranges from about 3.5 to about 3.75 inches. Accordingly, the taper preferably ranges from about 15 to about 25 degrees.

Figure 2:
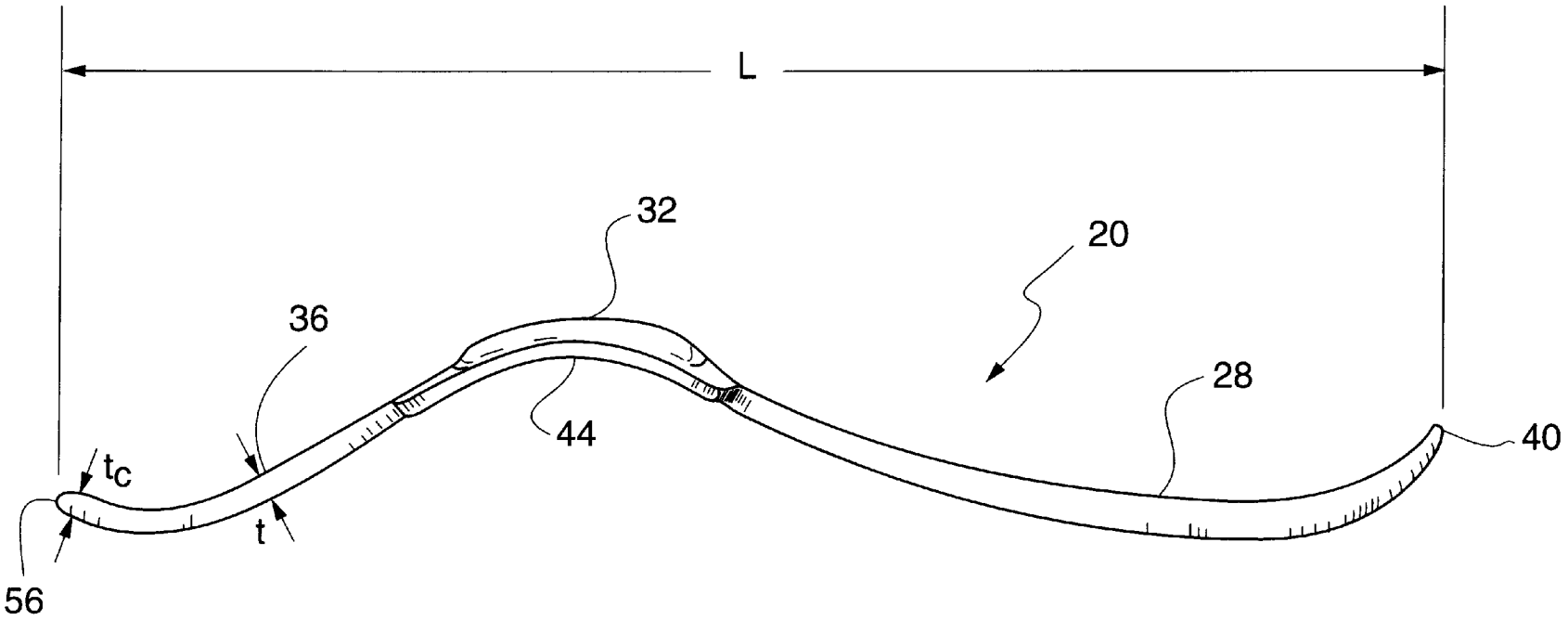
FIG. 2 is a side view of the device.
Figure 3:
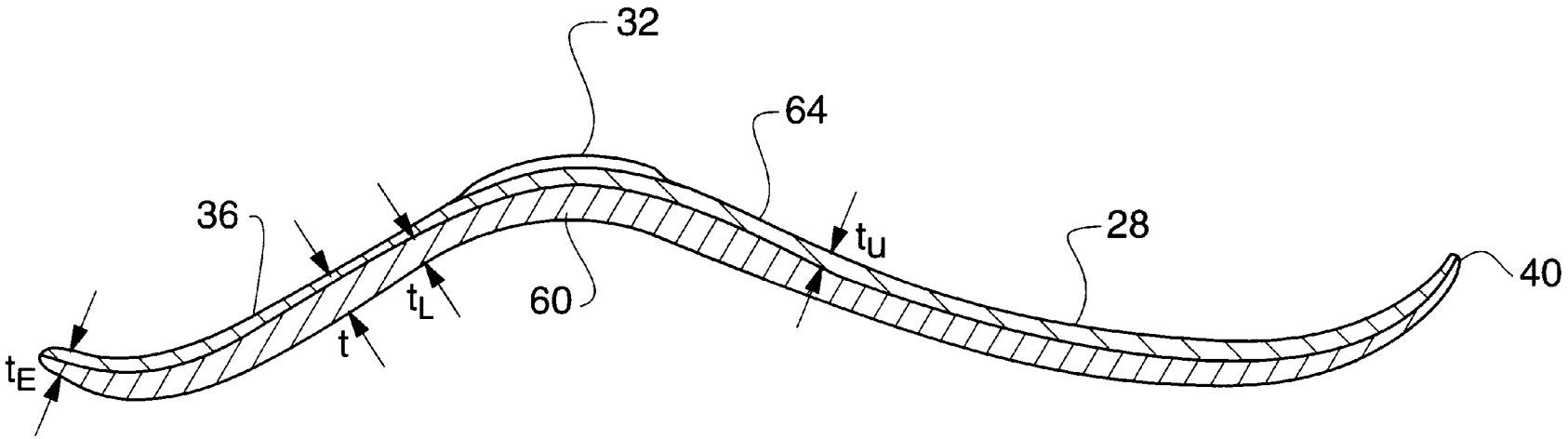
FIG. 3 is a sectional view of the device taken along line A—A of FIG. 1.
Figure 4:
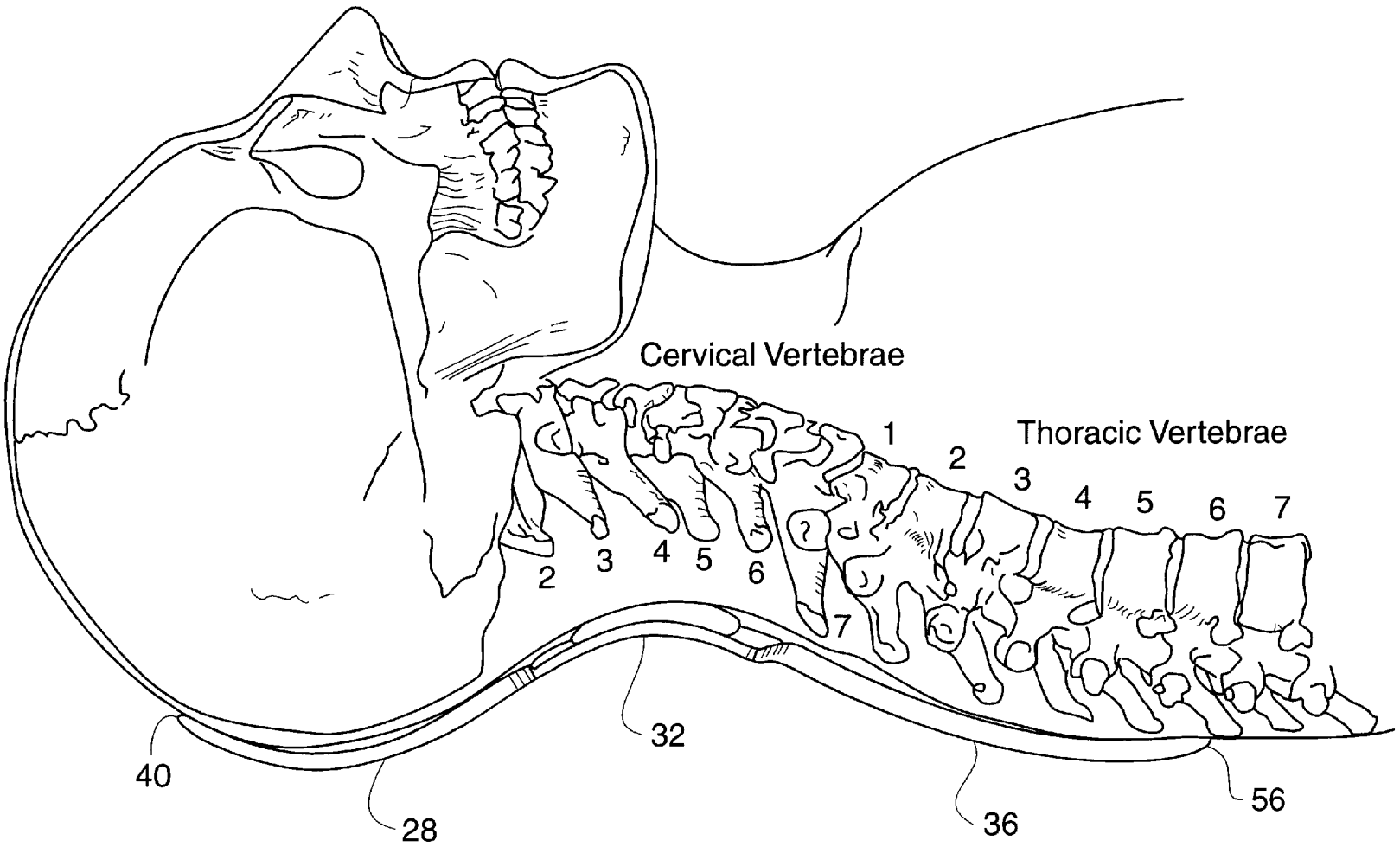
FIG. 4 is a side view of the device engaging a user's head, neck and upper back regions.

To avoid discomfort from the lower end 56 digging into the user's back when the user returns to the supine position, the lower end 56, as shown in FIGS. 2 and 3 is of reduced thickness relative to the remainder of the lower portion 36. The thickness "t" of the elongated member is relatively constant except at the lower end 56, the outer ½ inch of which is tapered in thickness. Preferably, at the end of the taper, the semi-rigid layer at the lower end 56 has a thickness "$t_E$" of no more than about 3 mm and preferably ranging from about 2 to about 2⅛ mm and most preferably a thickness "$T_E$" of about 1.25 mm.

The degree of pliability of the elongated member is another important factor to the performance of the device. If the member were to be too rigid, it would be to inflexible to adapt to slight fluctuations in the cervical lordosis and kydosis of different users. If the member were to be too pliable, it would provide only limited spinal support. Preferably, to provide the appropriate degree of pliability the lower semi-rigid layer 60 of the member is composed of polypropylene, polyethylene, and composites thereof and has a thickness "$t_L$" ranging from about 2.5 to about 5 mm and more preferably from about 2.5 to about 3.5 mm, and most preferably a thickness of about 3 mm.

To provide comfort to the user, the elongated member can include an upper cushioned layer 64 bonded to the lower semi-rigid layer 60. The cushioned layer can be composed of foam rubber, high density foam, and composites thereof. Preferably, the upper cushioned layer 64 has an average thickness "$t_u$" ranging from about 2 to about 4 mm and more preferably about 3 mm.

To prevent muscle strains, the device is relatively lightweight and, in a preferred embodiment, is not designed to engage ancillary weights, such as dumbbells. It is believed that the use of heavyweight abdominal exercise devices can cause unnecessary muscle strains. Preferably, the device has a weight of no more than about 1.5 lbs.

Figure 5:
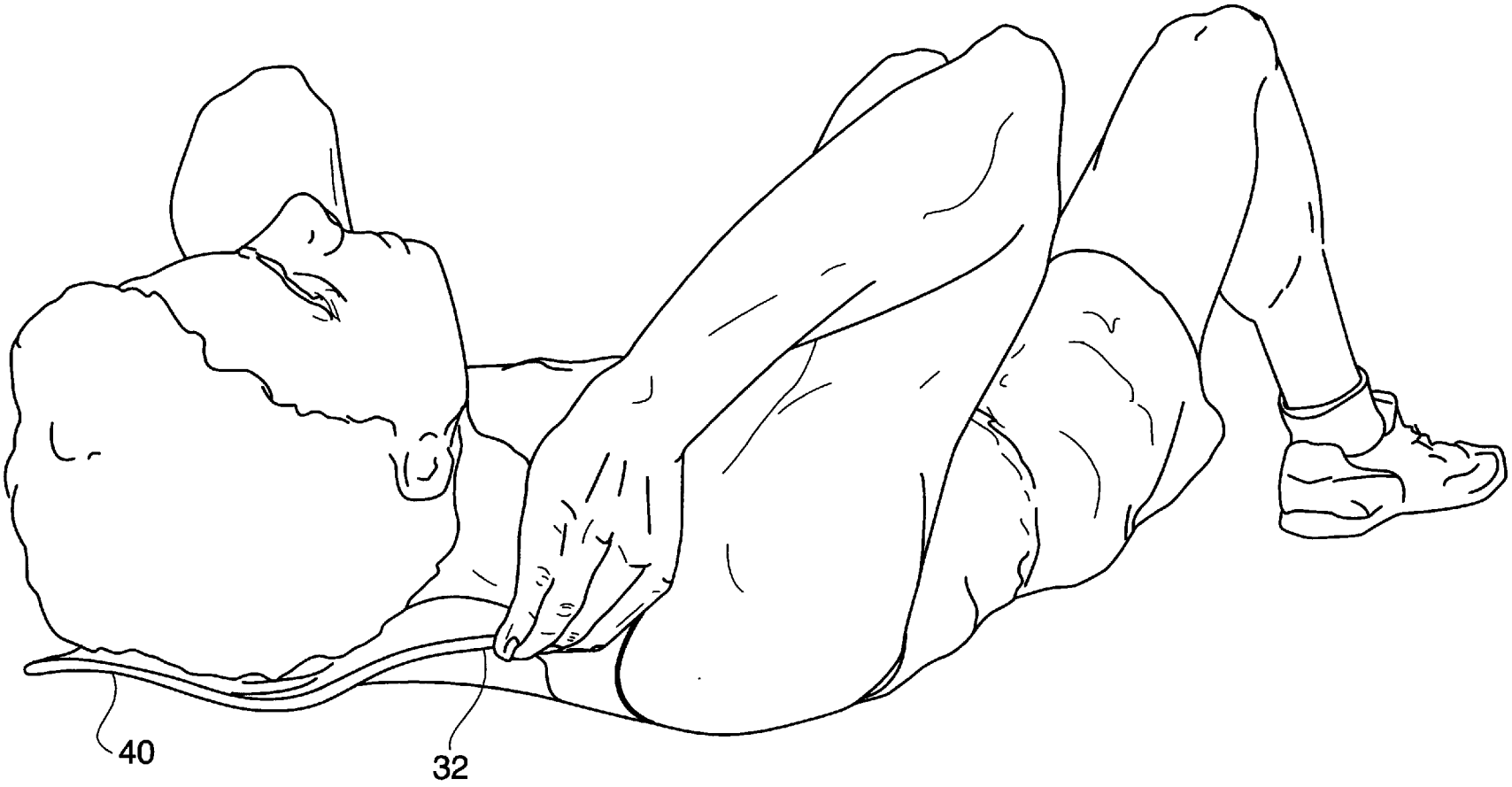
FIGS. 5 and 6 show the device in use during an abdominal crunch.
Figure 6:
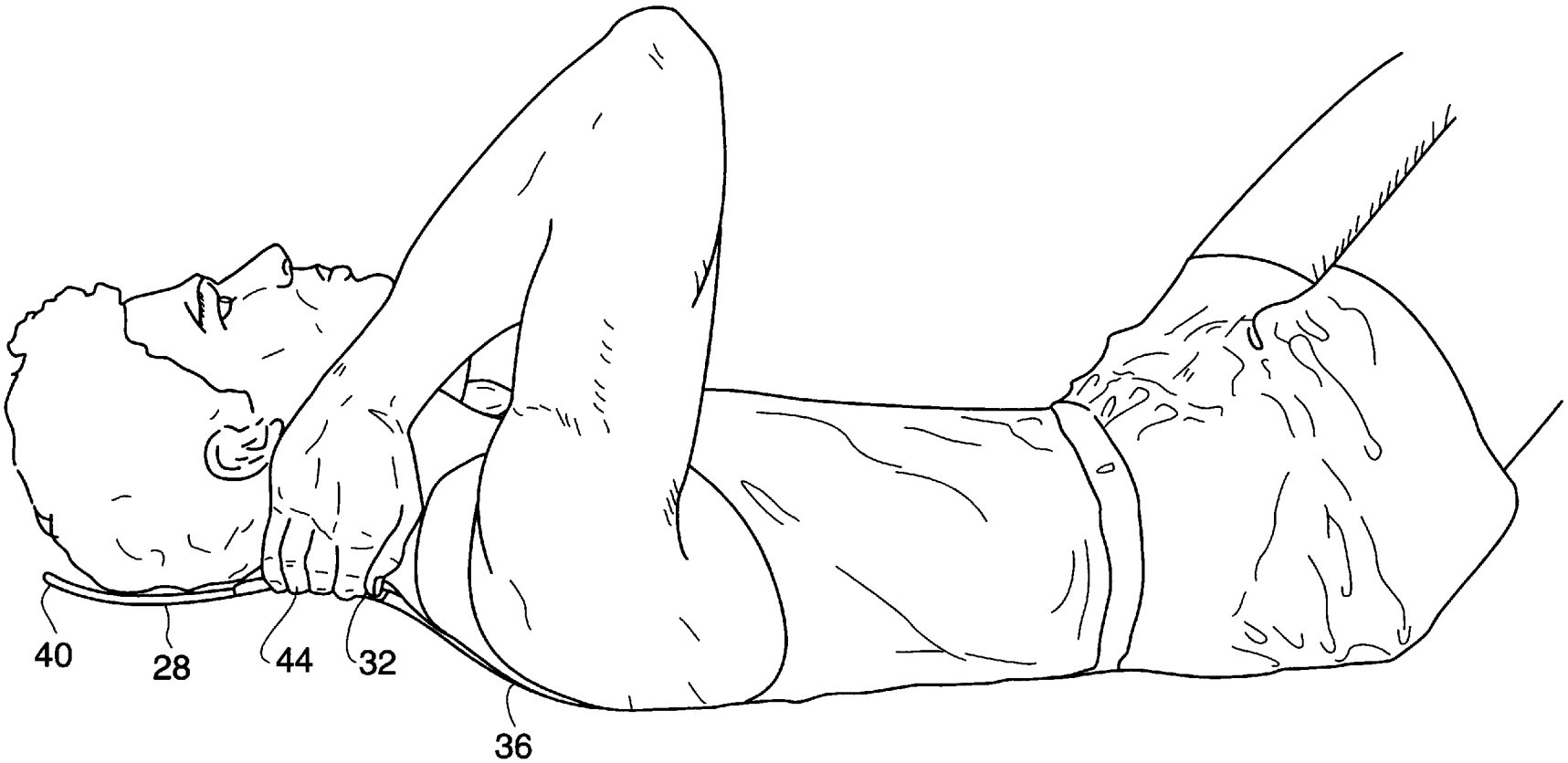

Referring to FIGS. 5 and 6, the device 20 is placed in position behind the user's head, neck, and back before a crunch is performed. The user assumes a supine position and grips the handholds 44 with both hands. He then bends his knees by drawing his heels in towards his buttocks. To begin the crunch, he curls his upper body into a concave position so the head, neck and shoulders are slightly elevated off the floor and the elbows are contacting the knees while pulling upward on the handholds. In this position, the rectus abdominous is contracted. He returns to the starting position, thereby relaxing the muscle, and repeats the sequence of steps for a desired number of repetitions. During the full range of motion of the crunches, it is important that the user keeps both of his hands on the handholds to properly engage the device.

Figure 7:
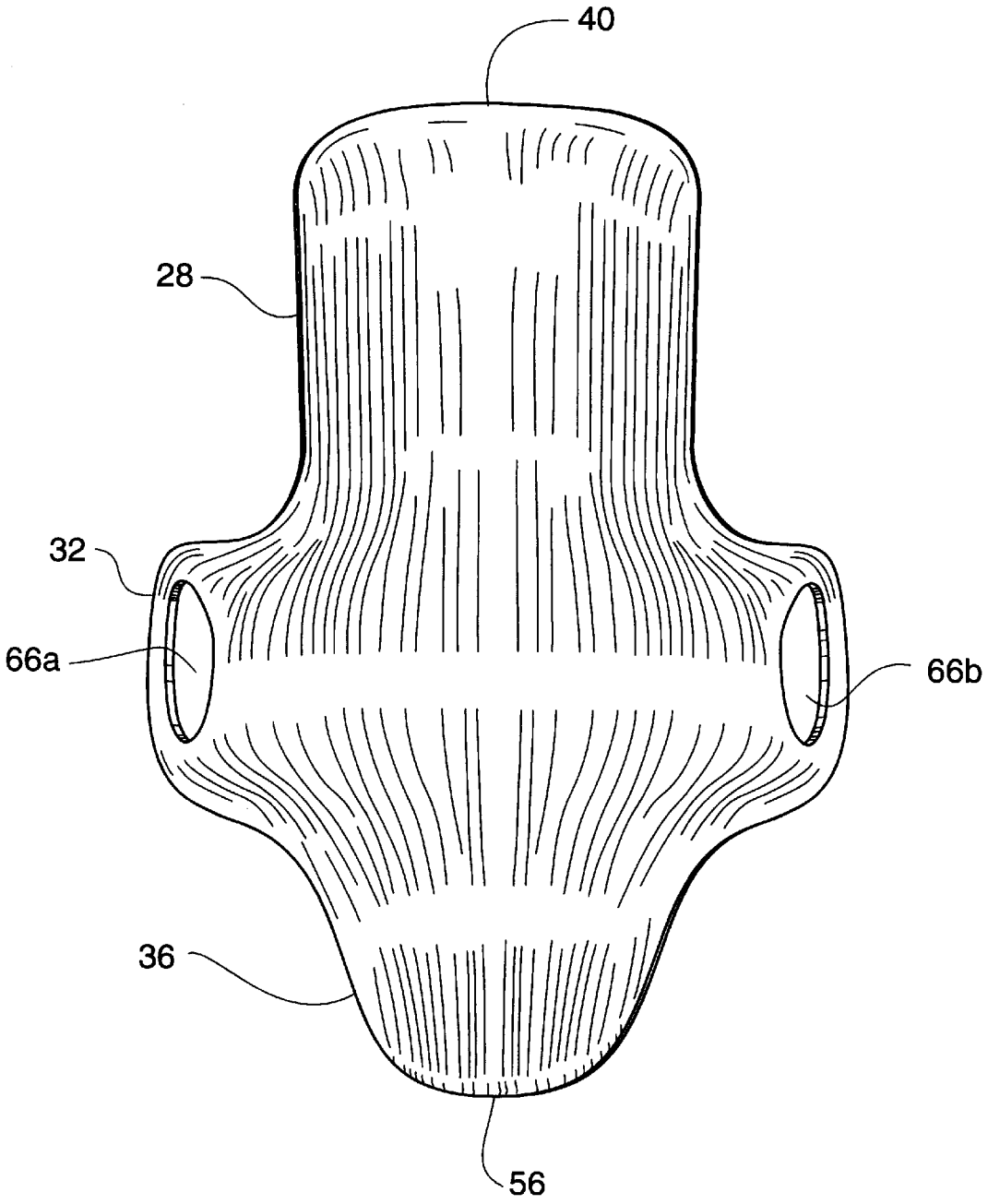
FIG. 7 is a plan view of second embodiment of the exercise device.
Figure 8:
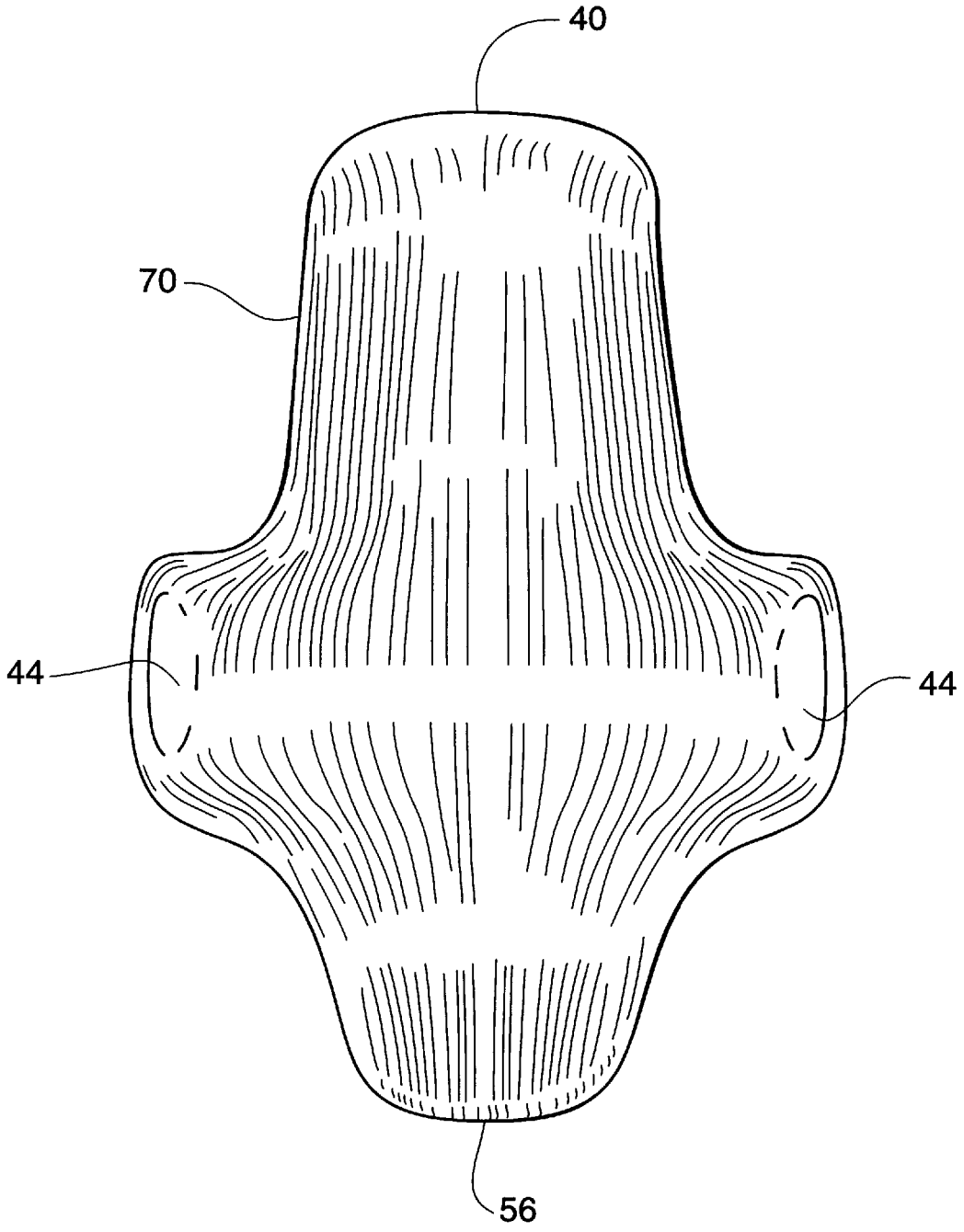
FIG. 8 is a plan view of a third embodiment of the exercise device.

A number of alternative embodiments of the present invention are possible. By way of example, a second embodiment in FIG. 7 is substantially identical to the first embodiment except that the handholds 66*a*, 66*b* pass completely through the middle portion. A third embodiment in FIG. 8 is substantially identical to the second embodiment except that the upper portion 70 is tapered.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. A device for exercising abdominal muscles, comprising:

an elongated member made of rigid material that is sized to extend the length of a portion of a user's spinal column, the elongated member having an upper end and a lower end, wherein the upper end is located adjacent to the user's head and the lower end is sized and configured to be located adjacent to the user's upper back, whereby the elongated member provides neck and back support during abdominal muscle exercises, and wherein the elongated member comprises at least one handhold formed of the same rigid material as said elongated member and that is sized and configured to be located substantially between said upper end and said lower end and wherein said member has a top side and a bottom side, said bottom side configured so that at least a portion of said bottom side adjacent said at least one hand hold does not contact the ground when said device is resting thereon.

2. The device of claim 1, wherein the lower end is sized and configured to be located adjacent to one of the second, third, fourth, and fifth thoracic vertebrae of the user.

3. The device of claim 2, wherein the lower end is sized and configured to be located adjacent to one of the third, fourth, and fifth thoracic vertebrae.

4. The device of claim 3, wherein the lower end is sized and configured to be located adjacent to the third thoracic vertebrae.

5. The device of claim 1, wherein the device has a weight of no more than about 1.5 lbs.

6. The device of claim 1, wherein a rigid layer at the lower end has a thickness of no more than about ⅛ inch.

7. The device of claim 1, wherein the elongated member includes a rigid layer composed of at least one of polyethylene, polypropylene, and composites thereof, the rigid layer having a thickness ranging from about 2.5 to about 55.0 mm.

8. The device of claim 1, wherein the elongated member has (a) a curved shape such that the elongated member substantially conforms to at least one of the user's cervical lordosis and kyphotic curve formed by the user's thoracic vertebrae and (b) an upper section of the elongated member is sized and configured to be located behind the user's head for supporting the user's head, a middle section of the elongated member is sized and configured to be located behind the user's neck for supporting the user's neck, and a lower section of the elongated member is sized and configured to be located behind the user's back for supporting the user's back, wherein the lower section is tapered such that at the junction between the middle and lower sections the lower section has a first width and at a lower end the lower section has a second width and the first width is more than the second width.

9. The device as set forth in claim 1, further comprising a cushioned layer bonded to said rigid layer.

10. The apparatus as set forth in claim 9, wherein said upper cushioned layer has a thickness of less than about 4 mm.

11. The apparatus as set forth in claim 1, wherein said elongated member further comprises a middle section that is in contact with the floor when said device is aligned on a flat surface.

12. The device as set forth in claim 1, wherein said handholds are formed of the same material as said device and wherein said device has a lower portion that is tapered, has a total width of no more than about 6.5 inches, and wherein said tapered portion ranges from about 15 to about 25 degrees.

13. The device as set forth in claim 1, wherein when said device is positioned on the ground, said upper end cradles a user's head and said upper end is curved upwards away from the ground at its uppermost end.

14. The device as set forth in claim 1, wherein said device has a curved ground contacting surface.

15. The device as set forth in claim 1, wherein said elongated member comprises at least a portion that is made of semi-rigid material.

16. A device for exercising abdominal muscles, comprising:

an elongated member having an upper end, a lower end and sides extending between said upper end and said lower end, said elongated member made of rigid material and sized and configured so that said upper end is able to support a user's head and said lower end is able to support a user's upper back and having a curved shape such that the elongated member is configured to substantially conform to at least one of the user's cervical lordosis and kyphotic curve formed by the user's thoracic vertebrae, wherein the elongated member comprises at least one handhold formed of the same rigid material as said elongated member and that is sized and configured to be located substantially between said upper end and said lower end, wherein said at least one hand hold extends outwardly from one of said sides of the elongated member, whereby the elongated member provides back support during abdominal muscle exercises.

17. The device of claim 16, wherein the elongated member further comprises at least one handhold sized and configured to be located substantially adjacent to one of the third, fourth and fifth cervical vertebrae.

18. The device of claim 16, wherein the elongated member has an upper end and a lower end, wherein the elongated member is sized and configured such that the upper end (a) is located adjacent to the user's head and the lower end is located adjacent to the user's upper back, and (b) has an upper portion of the elongated member is sized and configured to be located behind the user's head for supporting the user's head, a middle portion of the elongated member is sized and configured to be located behind the user's neck for supporting the user's neck, and a lower portion of the elongated member is sized and configured to be located behind the user's back for supporting the user's back, wherein the lower portion is tapered such that the at the junction between the middle and lower portions the lower portion has a first width and at a lower end the lower portion has a second width and the first width is more than the second width.

19. The device of claim 18, wherein the first width and the second width are each no more than about 5.25 inches.

20. The device of claim 18, wherein the total width of the lower portion is no more than about 6.5 inches.

21. The device of claim 18, wherein the lower portion has two opposing sides and each side is tapered.

22. The device of claim 21, wherein the taper of each side is substantially identical.

23. The device of claim 18, wherein the taper of the lower portion ranges from about 15 to about 25 degrees.

24. The device as set forth in claim 16, wherein said bottom side has portions adjacent said at least one hand hold elevated above the ground when said device is resting thereon.

* * * * *